US005662304A

United States Patent [19]

McDaniel

[11] Patent Number: 5,662,304

[45] Date of Patent: Sep. 2, 1997

[54] DEVICE FOR ANCHORING OBJECTS INTO BEACH SAND

[76] Inventor: William R. McDaniel, 9158 Saddlebow Dr., Brentwood, Tenn. 37027

[21] Appl. No.: 494,766

[22] Filed: Jun. 26, 1995

[51] Int. Cl.[6] ..... B65D 63/00

[52] U.S. Cl. ..... 248/499; 52/157; 52/165; 248/545

[58] Field of Search ..... 248/530, 545, 248/156, 499; 52/157

[56] References Cited

U.S. PATENT DOCUMENTS

| | | | |
|---|---|---|---|
| 2,103,948 | 12/1937 | Jones | 248/530 |
| 2,484,263 | 10/1949 | Atkinson | 248/156 X |
| 2,525,890 | 10/1950 | Gage | 248/156 X |
| 2,900,153 | 8/1959 | Lazur | 248/545 |
| 3,286,962 | 11/1966 | Warth | 248/545 |
| 3,662,436 | 5/1972 | Roza | 52/157 X |
| 4,819,904 | 4/1989 | Shpigel et al. | 248/530 X |
| 4,979,490 | 12/1990 | Nudo et al. | 248/545 X |
| 4,982,701 | 1/1991 | Papak | 248/156 X |
| 5,098,057 | 3/1992 | Gran et al. | 248/156 X |
| 5,358,209 | 10/1994 | Ward | 248/530 X |
| 5,457,918 | 10/1995 | Plourde | 248/545 X |
| 5,488,798 | 2/1996 | Beachel | 248/530 X |

FOREIGN PATENT DOCUMENTS

| | | | |
|---|---|---|---|
| 102830 | 8/1963 | Norway | 52/157 |

*Primary Examiner*—Leslie A. Braun
*Assistant Examiner*—Kimberly T. Wood

[57] ABSTRACT

A hollow, molded, cylindrical screw-threaded device for removably anchoring objects such as beach umbrellas, ropes, pet leashes, and the like into sand comprises a hollow cylinder with two fixed molded perpendicular winglike projections for its insertion. A thumbscrew in the side of the cylinder allows for grasping and release of objects inserted into the anchoring device. Screw threads which taper in diameter and depth successively as the tip is approached allow for easier insertion into compact deeper sand and also for firmer anchoring in looser surface sand. Beveled lower thread surfaces allow for easier insertion of the device and flat upper thread surfaces afford greater resistance against forcible removal of the device from the sand. Moveable loops of two alternate designs allow for pivoting attachment points for ropes, pet leashes, and the like.

8 Claims, 4 Drawing Sheets

DEVICE FOR ANCHORING OBJECTS INTO BEACH SAND

BACKGROUND OF THE INVENTION

This invention relates to a molded plastic or metal screw-threaded device for firmly securing or anchoring objects into sandy beach surfaces as are encountered beside lakes and at the seashore. Once screwed into the sand, the device resists removal and thus provides a solid anchor for umbrellas, pet leashes, and the like.

In recent years, people have begun to devote more time to recreational pursuits, many of which involve being in or near water. Ocean and lakeside beaches have become increasingly popular destinations for active, sun-loving people. Such people eventually accumulate a variety of items they need for enjoyment of the beach environment. Such items often include beach umbrellas to afford protection from the sun's harmful rays, a variety of chairs and chaises for comfortable relaxation, inflatable floats and rafts for floating in the lake or ocean, volleyballs with nets and poles for exercise and competitive sport, and leashes for the family dog if one is allowed to accompany its family to the beach.

While people generally go to beaches to encounter sun and surf, one other element of nature is an almost constant accompaniment and must constantly be reckoned with. Wind can afford a cooling respite from the sun's heat but it can also wreak havoc on beach paraphernalia. Umbrellas, for example, are generally held in the sand by penetration of the tip of their poles several inches into the sand. Strong gusts of wind are frequently noted to lift an entire umbrella and move it a distance away to the irritation and potential danger of the owner and other beachgoers nearby. Floats, rafts, and webbed aluminum-frame chairs are light enough to be rendered airborne by strong beach gusts. Such unwanted interruptions could be prevented entirely through the use of a device to firmly anchor these objects into the sand. Likewise, beach volleyball nets, which must be held taut to be fully functional, need to be on poles that are held securely by ropes tied to tight anchors. Dogs could be more conveniently kept on leashes while owners sleep, play, or swim, if a secure place existed to attach the leash.

Various attempts have been made to provide ground-anchoring devices for ropes and poles. In U.S. Pat. Nos. 292,129 and 773,386, spiral-threaded rods which penetrate the ground are used to hold guy ropes and poles. In U.S. Pat. No. 292,129, the threaded rod is connected to a T-bar which forms a point for tying ropes and is solid steel, thus having no ability to receive and hold an umbrella. In U.S. Pat. No. 773,386, the threaded rod is not itself capable of holding a pole or umbrella but merely forms one of three anchors for a tripod-like steel apparatus to which poles can be attached. U.S. Pat. Nos. 2,103,948 and 2,209,504 and 4,819,904 all describe spiral-threaded umbrella tips that are attached permanently to the umbrella pole before its insertion into the ground, making the pole then capable of being screwed into the ground. In U.S. Pat. No. 2,103,948, the coneshaped hollow tip is attached to the umbrella pole by tightening a ring clamp. The assembled unit can then be turned into the ground. Similarly, U.S. Pat. No. 2,209,504 describes a tip that is permanently affixed to the umbrella pole by flat-headed wood screws before the unit is inserted into the soil. In U.S. Pat. No. 4,819,904, where the base of the conical threaded tip is intended to be hammered into the open end of a tubular umbrella pole, the unit once again must be assembled before the tip is inserted into the ground. None of these devices would allow the umbrella to be removed while the anchoring device remains in the ground to be used to hold other objects. U.S. Pat. Nos. 2,441,109 and 2,628,797 and 4,832,304 describe detachable spiral-threaded devices intended to hold umbrellas in the ground. In U.S. Pat. No. 2,441,109, the umbrella pole is retained by an undisclosed "attachment member" and the spiral threads are small and shallow, making its use practical only in hard soil. A separate attachment is required for screwing the unit into the ground. Likewise, U.S. Pat. No. 2,628,797 and 4,832,304 disclose screw-threaded umbrella-holding posts that have shallow spiral threads on the tip for use in hard soil. They both also disclose a cam mechanism of holding the umbrella pole secure. In the latter, moveable metal wings move this cam and also serve as the means of screwing the holder into the soil. Neither unit has any features that would allow for its being used to anchor other objects such as ropes or pet leashes. Also, neither of these devices allow penetration of the inserted umbrella even to the level of the threads and, with so few threads anyway, neither can offer more than minimal stability in hard soil and even less in sand.

SUMMARY OF THE INVENTION

The present invention provides a one-piece, durable, lightweight molded anchor for holding beach umbrellas, volleyball pole ropes, pet leashes, or other beach paraphernalia which might either be subject to wind disturbance or in need of firm anchoring in sand. Particularly, this sand anchoring device consists of a hollow cylinder molded of either high-impact polypropylene or lightweight metal which is threaded at one end and has two stationary perpendicular molded wings or handles at the other to aid in turning the threads into the sand. A thumbscrew threaded into the cylinder is employed to secure umbrella poles or other poles into the hollow tubelike center of the device. A freely-revolving spring steel ring fitted into a groove molded into the top of the hollow cylinder at the end opposite the spiral threads serves as an attachment point for ropes or pet leashes.

BRIEF DESCRIPTION OF DRAWINGS

The invention will be more readily understood from the following description of certain embodiments, by way of example, in conjunction with the accompanying drawings, in which:

FIG. 5 is a top view of the spring steel attachment ring showing the small loop configured into it to provide a point of attachment for ropes, pet chains, and the like.

FIGS. 1,2,3,4, and 5 illustrate an embodiment of the invention and the features that make it uniquely suited for its utility as a multipurpose anchoring device to hold objects securely in sand.

DETAILED DESCRIPTION OF THE INVENTION

Figure 1:
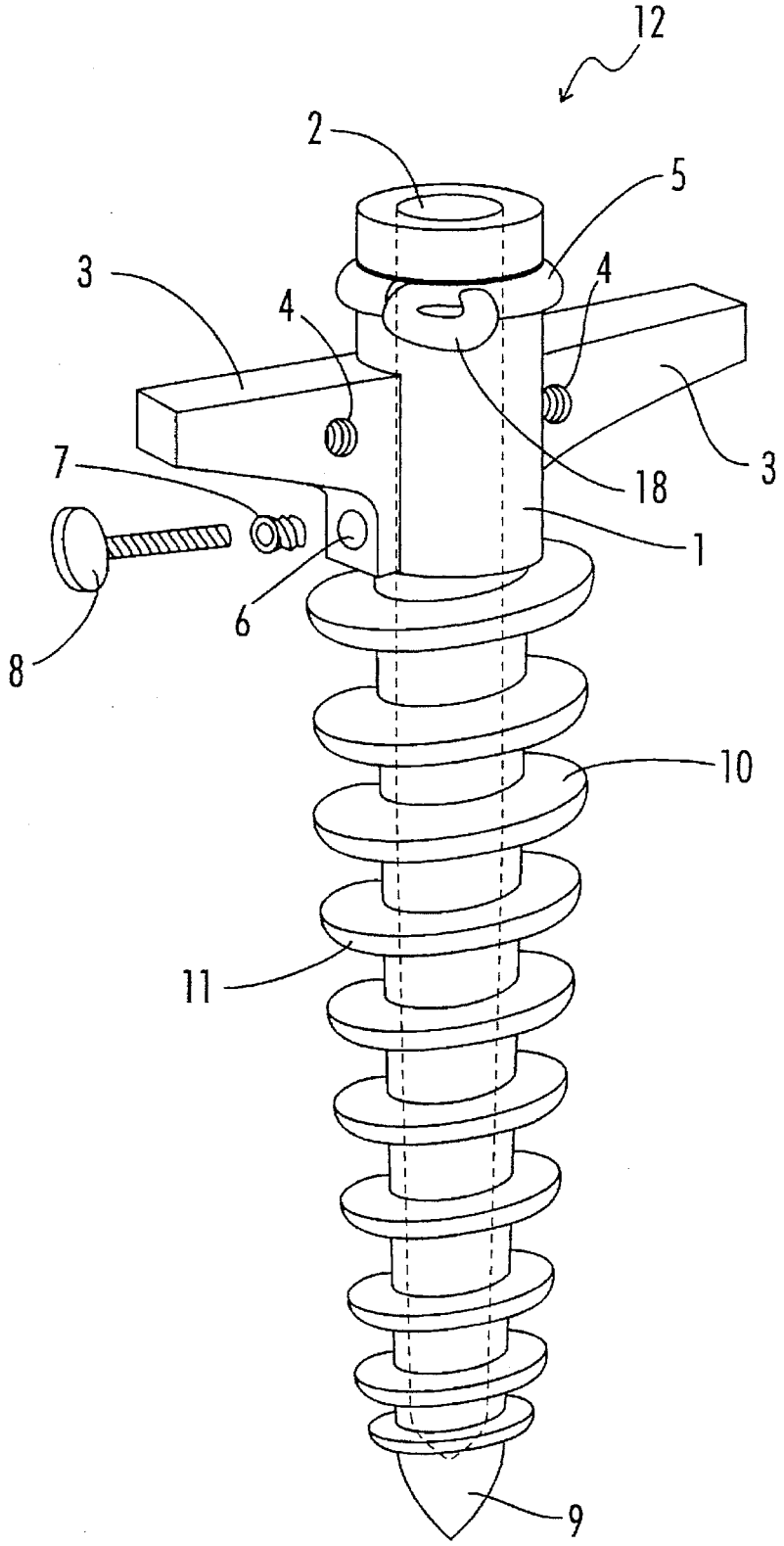
FIG. 1 is a perspective view of the invention.
Figure 2:
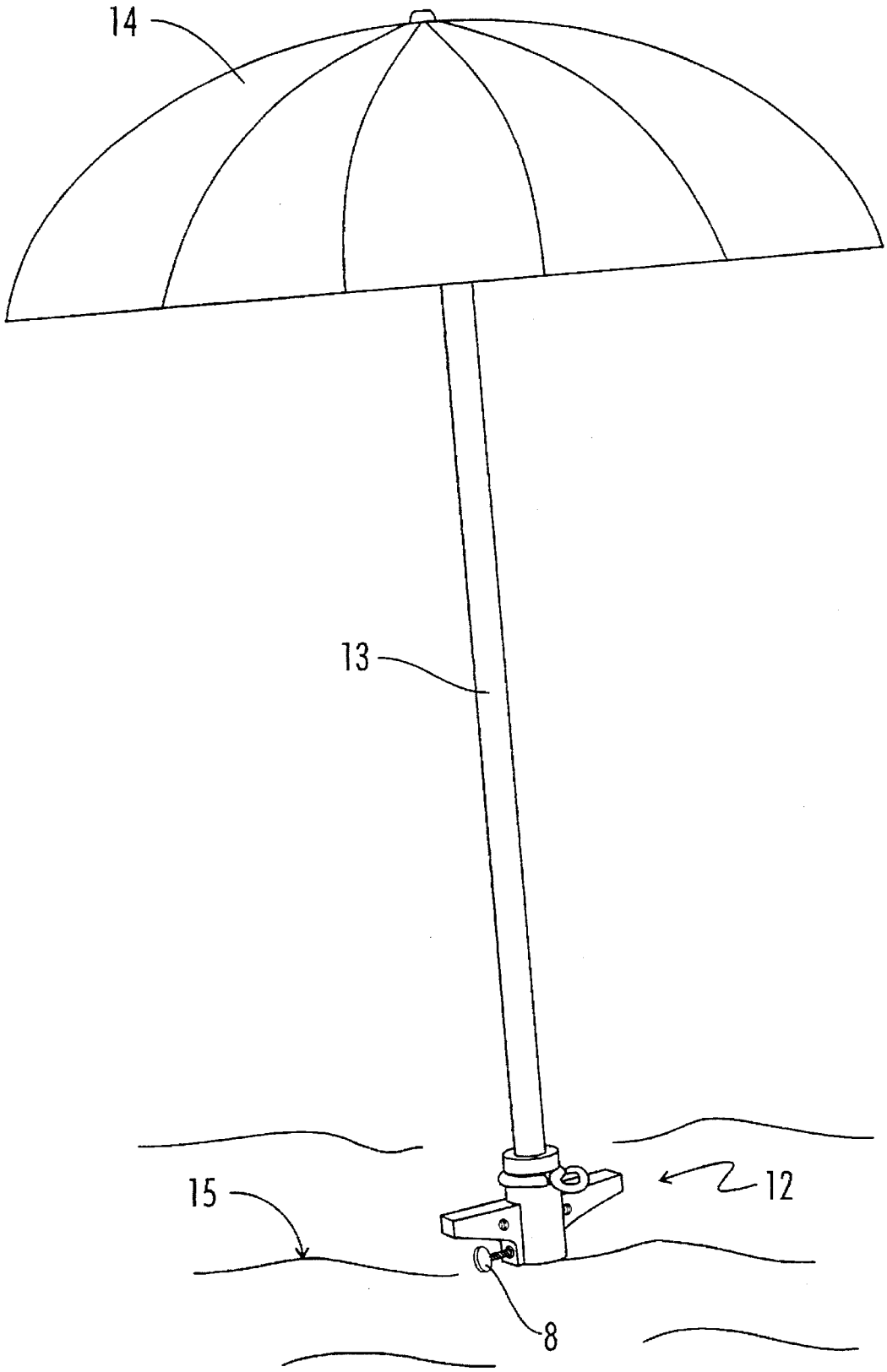
FIG. 2 is a side view of the invention implanted in sand and holding an umbrella.
Figure 3:
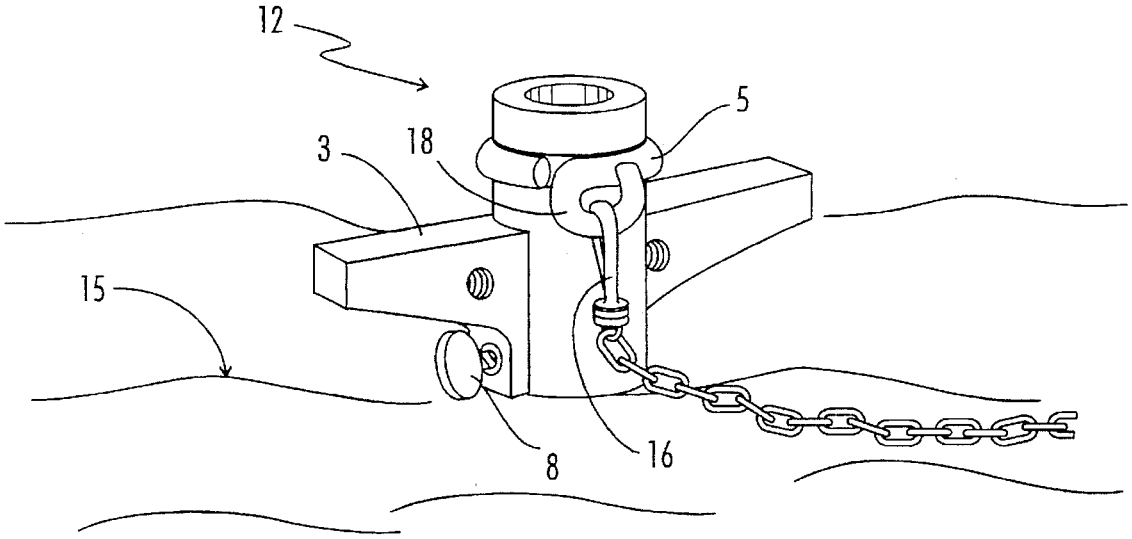
FIG. 3 is a side view of the invention where it has been screwed into the sand and has a pet restraint chain attached to it.

As illustrated in FIG. 1, a molded plastic or metal hollow, threaded anchoring device 12 comprises a hollow cylinder 1 with an opening 2 in its upper end opposite a threaded end whose molded threads become progressively smaller in depth and overall diameter as the tip 9 is approached. The small, shallow threads near the tip 9 allow for easy penetration of the sand at the time of insertion and better penetration into more compacted deeper sand several inches beneath the surface. As the threads are inserted deeper through a turning motion applied to the molded wings 3, the progressively larger and deeper threads nearer the top allow for better gripping of the device into the less compact surface sand. The design of the threads employs a rounded lower thread edge 11 which pushes sand out on the way on insertion and a flat upper thread surface 10 which holds sand better and makes it harder for the threads to be pulled forcibly out of the sand without the device being screwed out on purpose. Just beneath one of the molded wings 3, a hole 6 is bored (or molded) through the wall of the cylinder 1 and into the hollow center cavity. Into this hole is screwed a threaded metal insert 7 to serve as recipient for the threaded metal or plastic thumbscrew 8. The thumbscrew 8, when screwed into the screw insert 7, extends through the hole 6 in the cylinder wall and into the hollow cavity. This thumbscrew 8 serves as a setscrew to retain poles such as umbrella poles that are inserted into the hollow cavity of the anchoring device 12, as is shown in FIG. 2. Two holes 4, bored through the molded wings 3 near the point of their attachment to the cylinder 1 serve as attachment points for ropes that it may be desirable to tie to the anchoring device. A circular spring metal ring 5, as illustrated in FIGS. 1,3,4, and 5, fits into a molded channel-like groove 17 located near the top of the hollow cylinder 1 just above the molded wings 3. Installation of the ring 5 requires it to be forcibly spread open so it can slip over the top end of the hollow cylinder 1 which is slightly larger in diameter than either the unexpanded steel ring 5 or the groove 17. The expanded ring 5 is slid over the top of the cylinder 1 and allowed to close to its original configuration at the level of the groove 17. The inside diameter of the ring 5 is slightly larger than the outside diameter of the deepest part of the groove 17, thus allowing the ring 5 to move freely in the groove 17. One end of the spring steel ring 5 is turned outward into a small closed loop 18 which serves as a point of attachment for ropes and dog chains 16, as illustrated in FIG. 3. When a chain 16 or rope is attached to the small loop 18, the free movement of the larger loop 5 in the groove 17 allows for free revolution of the attached part about the installed anchoring device 12.

In FIG. 2, the umbrella 14 is shown anchored in the sand 15 by virtue of its pole 13 being inserted into the hollow center of the anchoring device 12 and the pole held in position by tightening of the thumbscrew 8. The anchoring device 12 has already been affixed in the sand by screwing its threaded end into the sand up to the level of the thumbscrew 8. Likewise, in FIG. 3, the anchoring device 12 has been screwed tightly into the sand and is, in this instance, employed to anchor a dog chain 16 which is attached to the pivoting steel ring 5 at the point of the small ring 18 bent into its end.

Figure 4:
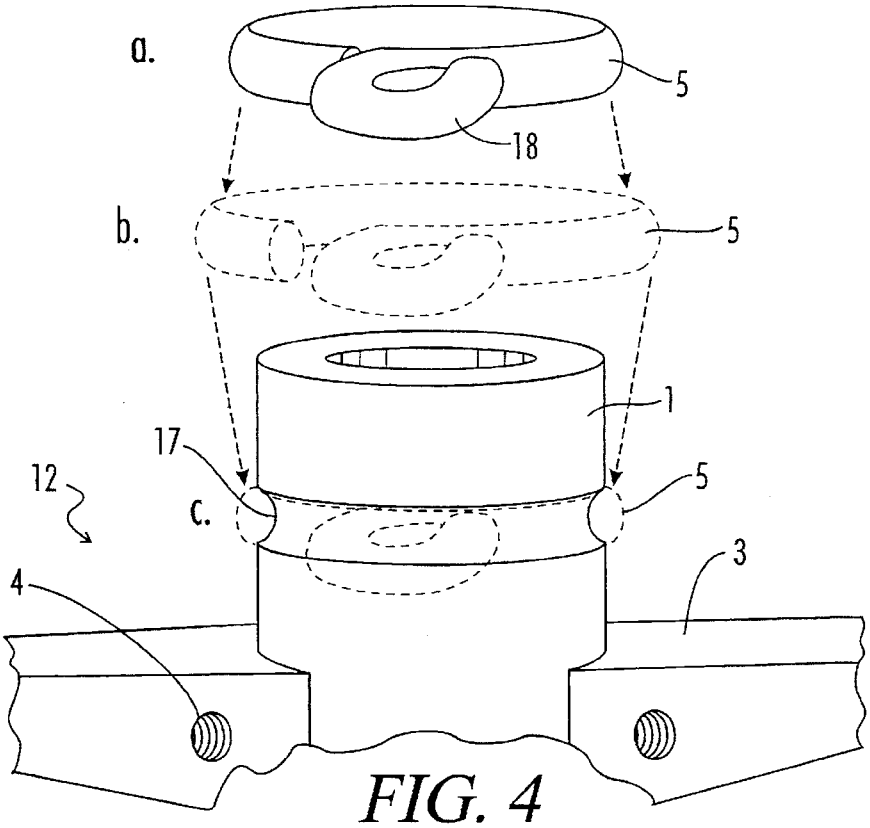
FIG. 4 is a close-up perspective view of the spring steel pivoting attachment ring at the top end of the invention, showing the molded groove into which it fits and the expansion of its diameter required at the time of its installation.

FIG. 4 demonstrates the method of installation of the spring steel pivoting ring 5 onto the top of the hollow cylinder 1. The three stages of installation are as follows:

a. Spring steel ring 5 in its unexpanded state prior to installation
b. Spring steel ring 5 forcibly expanded to allow it to pass over the end of hollow cylinder 1.
c. Spring steel ring 5 allowed to regain original configuration which causes a freely-moveable fit into groove 17 molded into the upper end of hollow cylinder 1.

Figure 5:
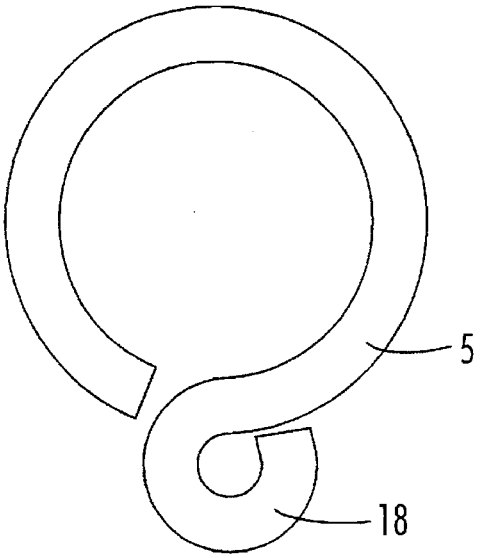

This configuration allows secure attachment of ropes, pet chains, and the like to the ring 5 at its attachment loop 18, which is formed prior to installation by heating and bending the end of the spring steel rod used to make the ring 5. Attached objects or pets can move around the anchoring device 12 freely because the ring 5 fits loosely into the molded groove 17, allowing free revolution or pivoting of the ring 5. FIG. 5 shows a top view of the spring steel pivoting ring 5. This ring is formed by heating and bending a length of rust- and corrosion-resistant spring steel into a circle with inside diameter just larger than the diameter of the deepest part of the groove 17 molded into the hollow cylinder 1 of the anchoring device 12 as shown in FIG. 4. A small attachment ring 18 is formed at one end of the rod and provides the point at which ropes, pet chains or leashes, and the like are attached to the assembled anchoring device 12 as shown in FIG. 3.

Figure 6:
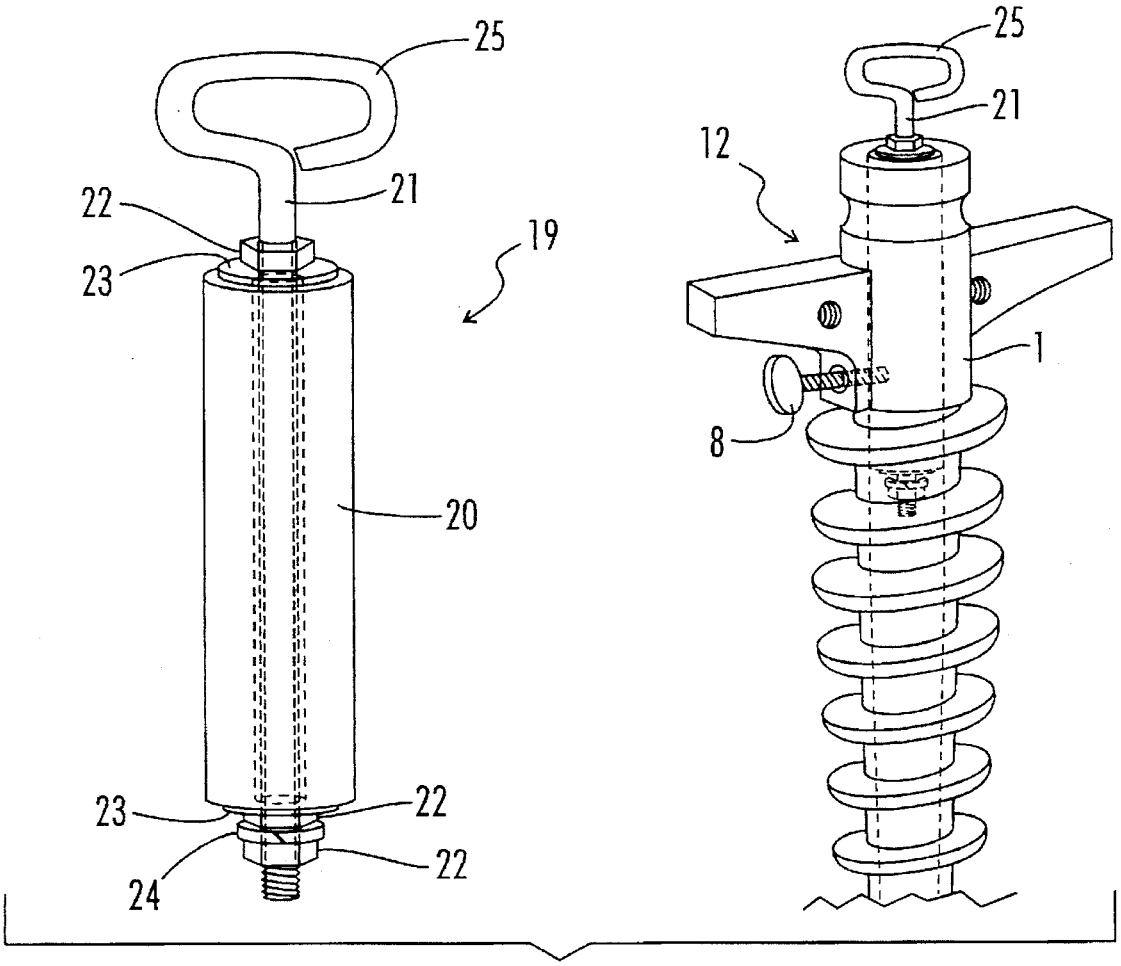
FIG. 6 is a view of an alternate mechanism for attaching ropes, pet leashes, and the like to the anchoring device which employs a steel rod having a loop at one end which pivots freely inside a plastic cylinder that can be affixed inside the hollow anchoring device by tightening the thumbscrew.

FIG. 6 illustrates an alternate embodiment of the invention which employs a pivoting attachment device 19 for attachment of ropes, pet chains, and the like. This device 19 employs a hollow plastic cylinder 20 whose outside diameter is just smaller than the inside diameter of hollow cylinder 1 of the sand anchoring device 12. A corrosion-resistant steel rod 21, threaded for approximately two-thirds of its length has a flattened oval loop 25 formed at its non-threaded end by bending the rod into a closed loop. A nut 22 is screwed onto the threaded end of the rod until it is stopped at the end of the threads. A plastic washer 23 is then slipped over the threaded end of the rod up to the level of the nut 22. Hollow plastic cylinder 20 is then slipped over the threaded end of the rod 21 until it stops against the installed washer 23 and nut 22. Next, another plastic washer 23 is slipped over the end of the threaded rod 21 and is tightened against the hollow plastic cylinder 20 by another steel nut 22. After the latter steel nut 22 is tightened to the point that the cylinder is held immobile, it is loosened one-half turn until the cylinder 20 can spin freely about it its threaded rod axis. A lock washer 24 is then placed over the end of the threaded rod 21 and an additional steel nut 22 is tightened against it while the immediately adjacent nut is held to prevent its movement. This assembled pivoting attachment device 19 can then be inserted into the hollow cylinder 1 of the sand anchoring device 12 and secured in place by tightening the thumbscrew 8 into the wall of the inserted cylinder 20. Once the cylinder 20 is secured in place, the loop at the top of the threaded rod 21 affords a freely-pivoting point of attachment for ropes, pet leashes, and the like.

The plastic parts of this invention are made in a variety of colors of high-impact polypropylene or a similar mar-resistant, tough plastic polymer. The threaded cylinder 1 and insertion wings 3 are molded in one piece by injection molding while the smaller cylinder 20 of the pivoting attachment device is formed from extruded plastic tubing or, alternatively, can be formed by boring out the center of a length of solid polypropylene rod. If desired, both these parts could be formed from a lightweight, rust-resistant metal alloy such as aluminum with no loss of functionality. All metal parts, including the spring steel attachment ring 5, the screw insert 7, the thumbscrew 8, the threaded rod 21, and the metal nuts 22 and lock washer 24 are made of rust- and corrosion-resistant metal. Plastic washers 23 are made of Teflon or another friction-reducing durable plastic to assist in the free pivoting of the threaded rod 21 within its housing cylinder 20.

The inside diameter of the hollow cylinder 1 of this sand anchoring device is large enough to accomodate even the largest commercial-grade beach umbrellas. At the same time, the smallest diameter recreational beach umbrellas may be secured by further tightening of the thumbscrew 8 into the cylinder 1.

This invention can be used by individual consumers who take their own umbrellas, volleyball nets and poles, pets, floats, and chairs to lakes or beaches when they go there. It could also have utility to commercial establishments such as beach services and resort hotels who rent umbrellas and chairs to their customers. Companies setting up for beach volleyball tournaments could use this anchor to provide form attachments for pole ropes where greater tension on the net is required. Surf fishermen could make use of such a secure anchor as a rod holder.

What is claimed is:

1. A hollow, cylindrical, screw-threaded device for anchoring objects into sand, comprising:

a molded cylinder with a smooth outer surface on approximately the upper 20 percent of the cylinder is length nearest the top and spiral screw threads on approximately the lower 80 percent the cylinder's length, with said spiral screw-threaded end tapering gradually toward a pointed tip;

a hollow, cylindrical cavity in the center of said cylinder running through its entire length except for approximately the last inch at the tip, thus allowing inserted umbrella poles to penetrate the sand maximally for increased stability;

a pair of short, winglike projections molded as part of the, upper, non-threaded portion of said cylinder in a perpendicular position relative to along axis of the cylinder which provide strong and nearly unbreakable points where torque can be applied to screw said cylinder into and out of the sand, these projections each having a hole bored therethrough near an attachment of the projection to said cylinder for the purpose of attaching a rope if desired;

a thumbscrew which screws into a metal screw insert which in turn is screwed permanently into a hole bored or molded into the wall of the upper, non-threaded portion of said cylinder which, when tightened, serves to prevent removal of umbrella poles or other poles or rods inserted into said hollow cavity inside said cylinder and, when loosened, serves to allow easy removal and interchange of poles after said cylinder has been screwed into the sand;

said spiral screw threads molded into the outside of approximately the distal 80 percent of said cylinder which are of maximal outside diameter and thread depth nearest to the top of said cylinder and which taper in both diameter and depth with each successive thread as the pointed tip is approached to allow the greatest lateral force and hold in looser, superficial sand and facilitated penetration of the tip into compact, deepest sand, respectively;

said spiral screw threads having a rounded and beveled lower edge to aid in pushing sand aside on insertion and a flat upper edge for better holding of sand to make forcible removal by a vertical pull more difficult once the device is screwed into the sand;

a pivoting steel ring which fits loosely in a groove molded into the upper non-threaded part of said cylinder and which has a smaller attachment ring bent into one of the ends of the pivoting/steel ring to serve as a point of attachment of ropes, pet leashes, and beach paraphernalia;

a hollow plastic rod having an outside diameter just smaller than that of the hollow cylindrical cavity which is removably-anchored into said device by tightening said thumbscrew and inside of which freely pivots a threaded steel rod whose uppermost end is bent into a flattened elliptical closed loop which affords a point of attachment for ropes or pet leashes when free rotation with less risk of entanglement is required.

2. A device as claimed in claim 1 where said threaded, hollow cylinder and said attached winglike projections are made of molded plastic.

3. The device of claim 2 where said molded plastic is polypropylene.

4. A device as claimed in claim 1 where said threaded hollow cylinder and attached winglike projections are made of lightweight, rust- and corrosion-resistant metal.

5. The device of claim 4 where said rust- and corrosion-resistant metal is aluminum.

6. A device as claimed in claim 1 where said thumbscrew, said steel pivoting ring, said screw insert, and said threaded steel rod are made of rust- and corrosion-resistant metal.

7. The device of claim 6 where said rust- and corrosion-resistant metal is brass.

8. The device of claim 6 where said rust- and corrosion-resistant metal is stainless steel.

* * * * *